US009917388B2

(12) United States Patent
Dumpler

(10) Patent No.: US 9,917,388 B2
(45) Date of Patent: Mar. 13, 2018

(54) MULTICORE CABLE

(71) Applicant: MD ELEKTRONIK GmbH, Waldkraiburg (DE)

(72) Inventor: Hubert Dumpler, Engelsberg (DE)

(73) Assignee: MD ELEKTRONIK GmbH, Waldkraiburg (DE)

( * ) Notice: Subject to any disclaimer, the term of this patent is extended or adjusted under 35 U.S.C. 154(b) by 0 days.

(21) Appl. No.: 15/435,334

(22) Filed: Feb. 17, 2017

(65) Prior Publication Data

US 2017/0244186 A1 Aug. 24, 2017

(30) Foreign Application Priority Data

Feb. 23, 2016 (EP) ..... 16156814

(51) Int. Cl.

| | |
|---|---|
| ***H01R 13/52*** | (2006.01) |
| ***H01R 13/02*** | (2006.01) |
| ***H01B 1/02*** | (2006.01) |
| ***H01R 13/506*** | (2006.01) |
| ***H01R 24/28*** | (2011.01) |
| *H01R 103/00* | (2006.01) |
| *H01R 13/627* | (2006.01) |

(52) U.S. Cl.

CPC ..... *H01R 13/025* (2013.01); *H01B 1/02* (2013.01); *H01R 13/506* (2013.01); *H01R 13/521* (2013.01); *H01R 13/5202* (2013.01); *H01R 13/5205* (2013.01); *H01R 24/28* (2013.01); *H01R 13/5219* (2013.01); *H01R 13/6275* (2013.01); *H01R 2103/00* (2013.01); *H01R 2201/26* (2013.01); *Y10S 439/93* (2013.01)

(58) Field of Classification Search

CPC .. H01R 13/025; H01R 13/5219; Y10S 439/93
See application file for complete search history.

(56) References Cited

U.S. PATENT DOCUMENTS 2,275,762 A * 3/1942 Horton ..... H01R 13/025 174/77 R
5,083,939 A * 1/1992 Ittah ..... H01R 12/777 439/496

(Continued)

FOREIGN PATENT DOCUMENTS

CN 202855332 U 4/2013
DE 20215523 U1 3/2004

(Continued)

*Primary Examiner* — Tho D Ta

(74) *Attorney, Agent, or Firm* — Leydig, Voigt & Mayer, Ltd.

(57) ABSTRACT

A cable includes a line and a coupling housing. The line includes a plurality of cores and a sheath. The sheath is radially outwardly disposed relative to the cores. Each of the cores has a conductor and an insulation surrounding the conductor. Each of the conductors is stripped of the insulation at an end of the cores. A coupling housing including a coupling ring, a pin housing, and a sealing element. The coupling ring embraces the pin housing and the sheath and is fixed to the sheath. The pin housing surrounds the stripped ends of the conductors. The sealing element is disposed between the coupling ring and the pin housing. The conductors are formed of a solid and coated steel wire and the stripped ends of the conductors are useable as pin contacts.

17 Claims, 4 Drawing Sheets

(56) References Cited

U.S. PATENT DOCUMENTS

| | | | | | |
|---|---|---|---|---|---|
| 5,667,405 | A * | 9/1997 | Holliday | ..... | H01R 9/0518<br>439/271 |
| 5,803,770 | A * | 9/1998 | Swendson | ..... | A61B 5/021<br>29/843 |
| 2009/0107721 | A1 | 4/2009 | Miller et al. | | |
| 2013/0217277 | A1 | 8/2013 | Friese et al. | | |

FOREIGN PATENT DOCUMENTS

| | | | | | |
|---|---|---|---|---|---|
| EP | 1780836 | A2 | 5/2007 | | |
| EP | 2629377 | A1 | 8/2013 | | |
| GB | 558103 | * | 12/1943 | ..... | H01R 13/025 |

* cited by examiner

Fig. 7 B - B

MULTICORE CABLE

CROSS-REFERENCE TO PRIOR APPLICATION

Priority is claimed to European Patent Application No. EP 16 156 814.2, filed on Feb. 23, 2016, the entire disclosure of which is hereby incorporated by reference herein.

FIELD

The present invention relates to a prefabricated multicore cable, which, in particular, includes a coupling housing, for transmitting electrical signals, respectively voltages.

The cables in question can be used in motor vehicles or aircraft, for instance, and, for the most part, are needed in large quantities. To provide such cables inexpensively, a simple design and ease of fabrication are vitally important. Excellent process reliability and a high level of precision are needed to manufacture such cables, as is required for a high-quality signal transmission, for example. Cables of this kind must also be designed to be as unsusceptible as possible to electromagnetic interference and to emit little interfering radiation to ensure that no emitted electromagnetic waves are able to cause interference in the on-board electronics of the particular vehicle, for example. Moreover, it is often necessary that such cables be manufactured to be capable of transmitting signals of relatively high frequency.

BACKGROUND

The European Patent Application EP 2 629 377 A1 describes a cable on whose conductors, end pieces are mounted as plug-type contacts.

The cable discussed therein is relatively complex in design, so that it is quite costly to manufacture. Accordingly, reliable assembly or fabrication proves to be relatively expensive.

SUMMARY

In an embodiment, the present invention provides a cable including a line and a coupling housing. The line includes a plurality of cores and a sheath. The sheath is radially outwardly disposed relative to the cores. Each of the cores has a conductor and an insulation surrounding the conductor. Each of the conductors is stripped of the insulation at an end of the cores. A coupling housing including a coupling ring, a pin housing, and a sealing element. The coupling ring embraces the pin housing and the sheath and is fixed to the sheath. The pin housing surrounds the stripped ends of the conductors. The sealing element is disposed between the coupling ring and the pin housing. The conductors are formed of a solid and coated steel wire and the stripped ends of the conductors are useable as pin contacts.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following:

FIG. 7 shows another side view of the cable in the state in accordance with FIG. 6.

DETAILED DESCRIPTION

Figure 1:
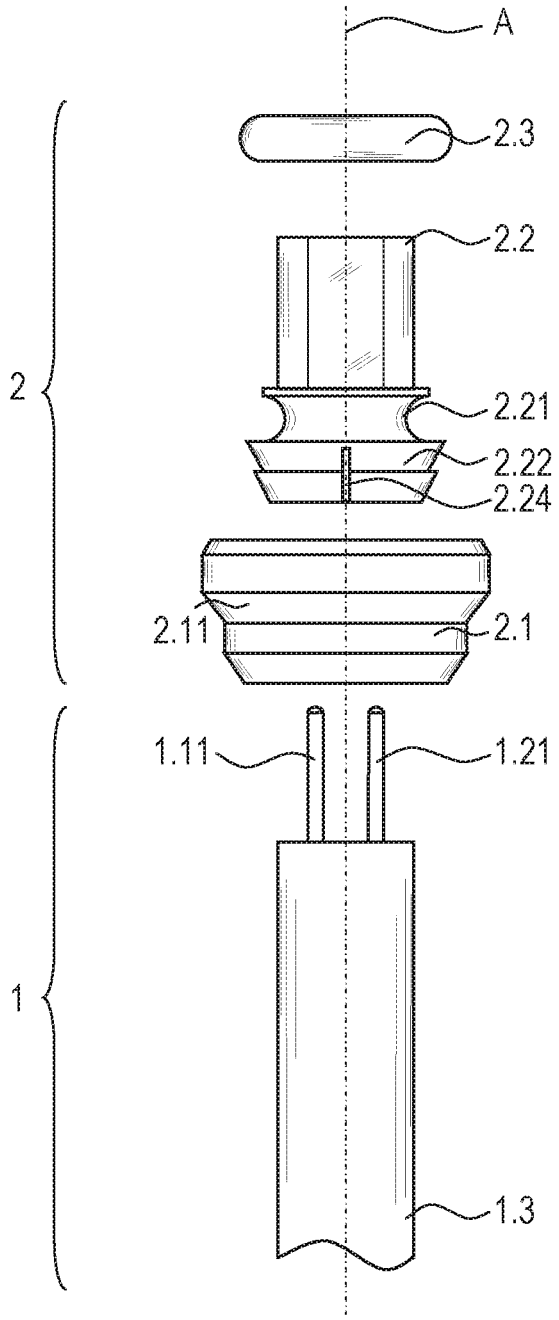
FIG. 1 shows a side view of a cable including a line and the individual components of a coupling housing.

In an embodiment, the present invention provides a cable that is high-grade and, nevertheless, relatively simple to manufacture.

In accordance with an embodiment of the present invention, the cable includes a line and a coupling housing. The line has a plurality of cores and a sheath; the sheath being radially outwardly disposed relative to the cores. The plurality of cores each have a conductor and an insulation surrounding the particular conductor, the conductors each being stripped at an end of the cores. This means that the insulation is removed at these ends, exposing the conductors. The coupling housing includes a coupling ring, a pin housing, and a sealing element. The coupling ring embraces the pin housing and the sheath, the coupling ring being fixed to the sheath. The—in particular, electrically insulating—pin housing surrounds the stripped conductors of the cores. Over the axial extent thereof, the stripped, respectively exposed conductors may be completely or only partially encircled by the pin housing. The coupling housing also includes a sealing element that is configured between the coupling ring and the pin housing, so that the gap is, therefore, sealed between the coupling ring and the pin housing. The conductors are fabricated from a solid and coated steel wire; the stripped ends of the conductors serving as pin contacts, respectively as pins of a plug-type connector.

Accordingly, the conductors are not manufactured from individual wires. Moreover, the conductors are not surrounded by the sheath at the one stripped end. In other words, the line is bared at the end in question.

In particular, the design of the new cable is such that the spacing of the conductors in the pin housing does not deviate or only minimally deviates from the spacing of the conductors in the line itself. Accordingly, within the line, the spacing of the conductors is the same as or only minimally deviates from the stripped ends of the conductors that may be used as pin contacts.

In a further embodiment of the present invention, the pin contacts serving as the stripped ends of the solid conductors are curved. Alternatively, the pin contacts serving as stripped ends of the conductors may feature a chamfer, and thus be chamfered.

In particular, the ends of the conductors may be machine cut, for example, to produce the curvature or the chamfer. Alternatively or additionally, the ends of the conductors may be coated to produce the curvature or the chamfer.

The pin housing is advantageously fixed to the sheath by a press-fit connection. In another embodiment of the present invention, the pin housing is additionally or alternatively fixed to the sheath by an adhesive bond. In such a case, the adhesive bond may be produced between the conductors, respectively around the conductors by selectively applying a metered quantity of an adhesive, so that not only a mechanical joint, but also a seal is thereby created between the lines and the pin housing.

One advantageous embodiment provides that the cable be configured in such a way that the sealing element is in the form of an O-ring seal. Alternatively or additionally, the sealing element may be integrally formed on the pin housing by an extrusion process, for example.

The sealing element may be advantageously embraced by the coupling ring. In particular, over the axial extent thereof, the sealing element may be completely or at least partially received in the coupling ring.

In another embodiment of the present invention, the pin housing has at least one snap-fit element, which cooperates with a correspondingly shaped region of the inner surface of the coupling ring to allow the coupling ring to lock the pin housing into place. In particular, the locking engagement immovably fixes the pin housing axially in place in the coupling ring.

On the outer surface thereof, the coupling ring advantageously has an offset that is suited for locking engagement with a socket body.

The present invention is especially advantageous for a cable whose line is in unshielded form.

In a side view before component assembly, FIG. 1 shows a cable for transmitting signals that, in particular, is designed for installation in a vehicle. The cable includes an unshielded line 1 that is only partially shown in the figure, and a coupling housing 2, respectively a coupling element.

A coupling element may likewise be provided at the other end of the cable. The cable, shown in an exploded view, has a longitudinal axis A.

Figure 2A:
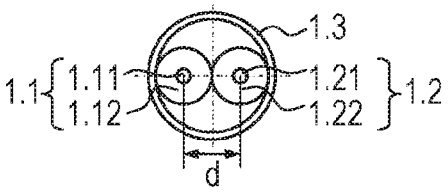
FIG. 2*a* shows a front view of the line.

In the exemplary embodiment presented here, line 1 has two cores 1.1, 1.2 (FIG. 2*a*). Cores 1.1, 1.2 each include a conductor 1.11, 1.21, conductors 1.11, 1.21 being fabricated from a solid and coated steel wire. In the exemplary embodiment presented here, the steel wire coating is made of a copper alloy. Alternatively or additionally, a silver alloy may be used as a coating material, for example. Within line 1, conductors 1.11, 1.21, respectively the centers thereof feature a spacing d. Over most of the length of the cable, conductors 1.11, 1.21 are surrounded by an insulation 1.12, 1.22. Radially outwardly disposed relative to cores 1.1, 1.2 is an insulating sheath 1.3, which embraces cores 1.1, 1.2 over a substantial portion of the line length. Over a substantial portion of the axial extent thereof, cores 1.1, 1.2 are stranded within line 1.

In the course of manufacturing the cable, a line 1 of this kind is first provided. Line 1 is cut, so that a first cut surface is produced at the cut end thereof; cores 1.1, 1.2, as well as sheath 1.3 being equal in length, respectively having a flush configuration.

Next, cores 1.1, 1.2 are exposed at the relevant end of line 1. For this purpose, in one work operation, sheath 1.3 at the end of line 1 and insulations 1.12, 1.22 at the ends of cores 1.1, 1.2 are cut down to conductors 1.11, 1.21 or at least nearly down to conductors 1.11, 1.21. To this end, a laser may be used, for example. Subsequently thereto, the severed portions of insulations 1.12, 1.22 are jointly removed at the ends of cores 1.1, 1.2, together with the severed piece of sheath 1.3.

The ends of conductors 1.11, 1.21 are subsequently rounded, so that line 1 is in the state in accordance with FIG. 1.

In addition to line 1, the cable in accordance with the present invention has a coupling housing 2. It includes a coupling ring 2.1, a pin housing 2.2, and a sealing element 2.3, which, in the exemplary embodiment presented here, is in the form of an O-ring seal.

On the outer surface thereof, coupling ring 2.1 features an offset 2.11, respectively an undercut. Thus, the inner diameter of coupling ring 2.1 may be dimensioned to be slightly smaller than the outer diameter of sheath 1.3. In particular, coupling ring 2.1 may feature inwardly projecting shoulders, whose distance to axis A is smaller than the distance of the outer surface of sheath 1.3 to axis A.

Figure 2B:
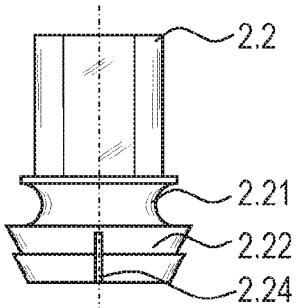
FIG. 2*b* shows a side view of a pin housing of the cable.
Figure 2C:
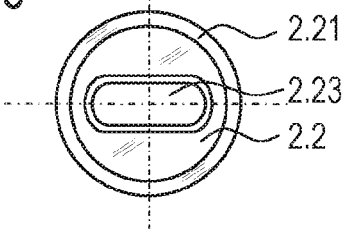
FIG. 2*c* shows a front view of the pin housing.
Figure 3:
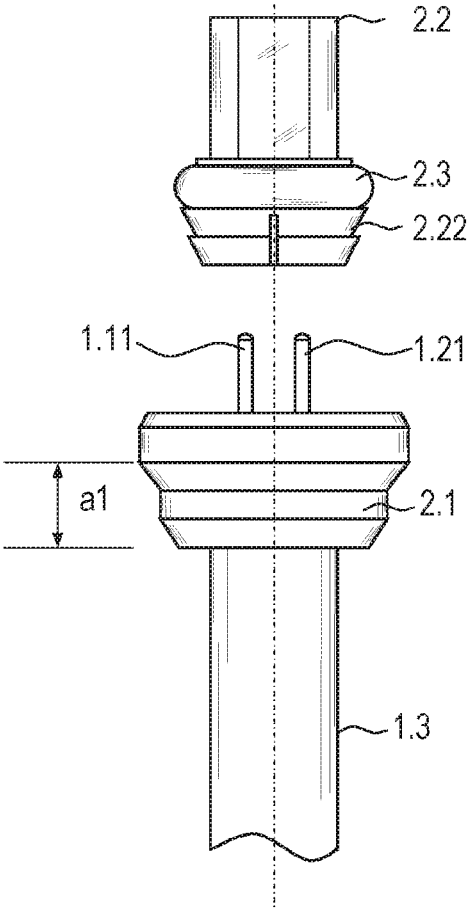
FIG. 3 shows a side view of the cable in an assembly phase.

One-piece pin housing 2.2 features an axially traversing recess 2.23 and a circumferential groove 2.21 (see also FIG. 2*b*, 2*c*), as well as a snap-fit element 2.22, which, in the exemplary embodiment presented here, has slots 2.24, for example, three slots 2.24, and two conical outer surfaces.

At this stage of preparation of line 1, coupling ring 2.1 is slid onto sheath 1.3; respectively sheath 1.3 is inserted through coupling ring 2.1. Coupling ring 2.1 embraces sheath 1.3 over an axial extent a1.

Moreover, during further assembly, sealing element 2.3, here the O-ring seal, is secured to pin housing 2.2 in that it is axially slid into groove 2.21 under elastic deformation.

Finally, pin housing 2.2, together with sealing element 2.3, is inserted into coupling ring 2.1, allowing pin housing 2.2 to encircle sheath 1.3, i.e., stripped conductors 1.11, 1.21 of cores 1.1, 1.2. Groove 2.21 and sealing element 2.3 are designed to ensure that, relative to sealing element 2.3, pin housing 2.2 is captively assembled in coupling ring 2.1. Due to the geometric form of coupling ring 2.1 and pin housing 2.2, pin housing 2.2 is pressed against the outer circumferential surface of sheath 1.3; due to slots 2.24, the end of pin housing 2.2 is relatively easily deformable, respectively compressible. To enhance the retention force and/or the impermeability of the system, pin housing 2.2 may also be adhesively bonded to sheath 1.3. In accordance with FIG. 4, coupling ring 2.1 embraces pin housing 2.2 and, specifically, over an axial extent a2.

Figure 4:
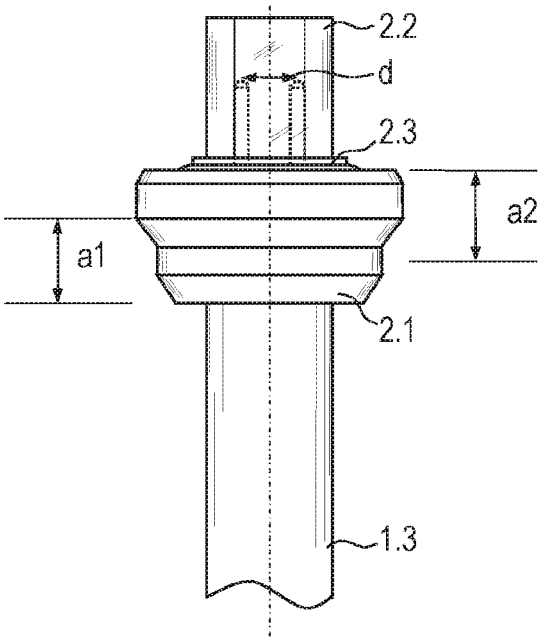
FIG. 4 shows a side view of the cable upon completed assembly.

A connector is thereby produced where stripped conductors 1.11, 1.21 are directly used as pin contacts, respectively as pins of the connector. FIG. 4 shows the cable in the final assembled state in which sealing element 2.3 is encircled by coupling ring 2.1. A captive design is thereby ensured for sealing element 2.3. In accordance with FIG. 2*a*, the spacing of the pin contacts, respectively of the pins of the connector corresponds to spacing d of conductors 1.11, 1.21 in line 1.

Figure 5:
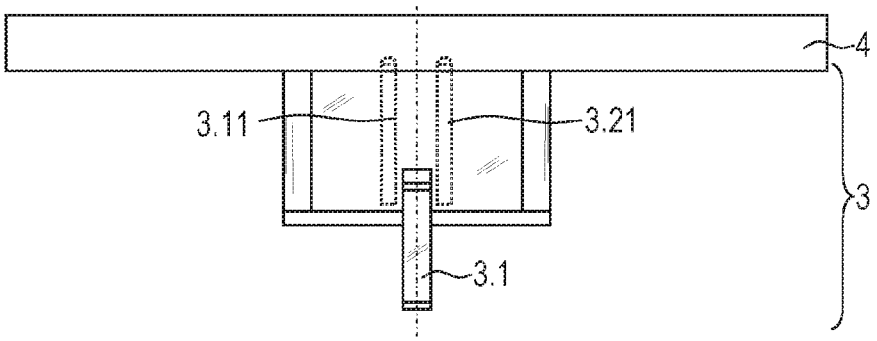
FIG. 5 shows a side view of a socket body.
Figure 6:
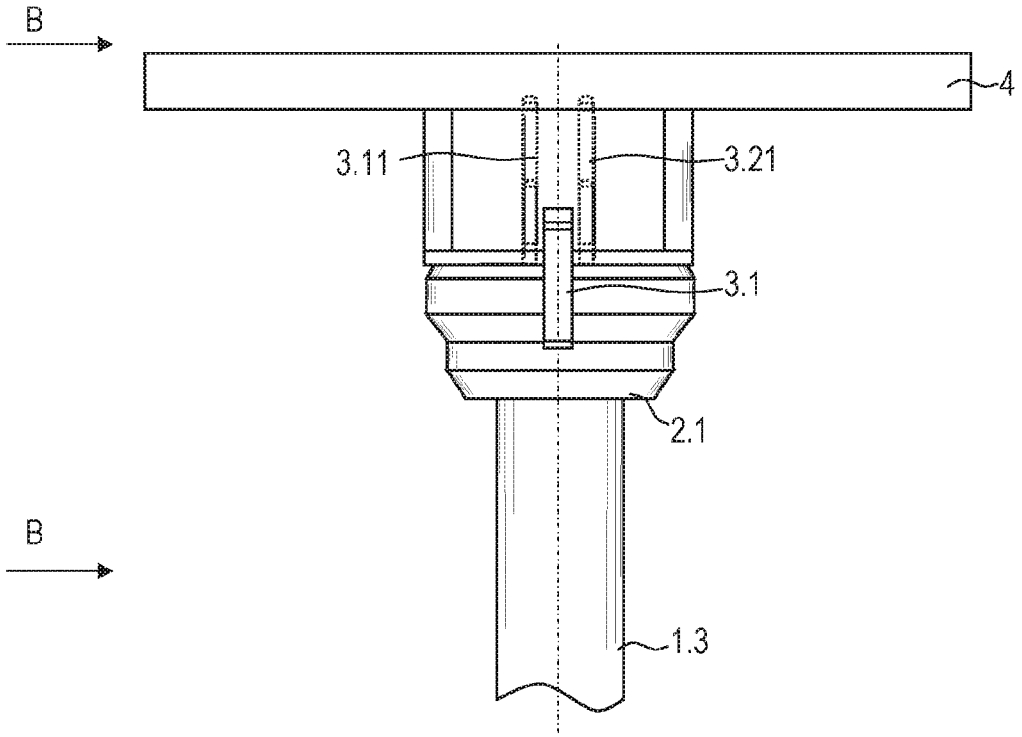
FIG. 6 shows a side view of the cable that is coupled to the socket body.
Figure 6:
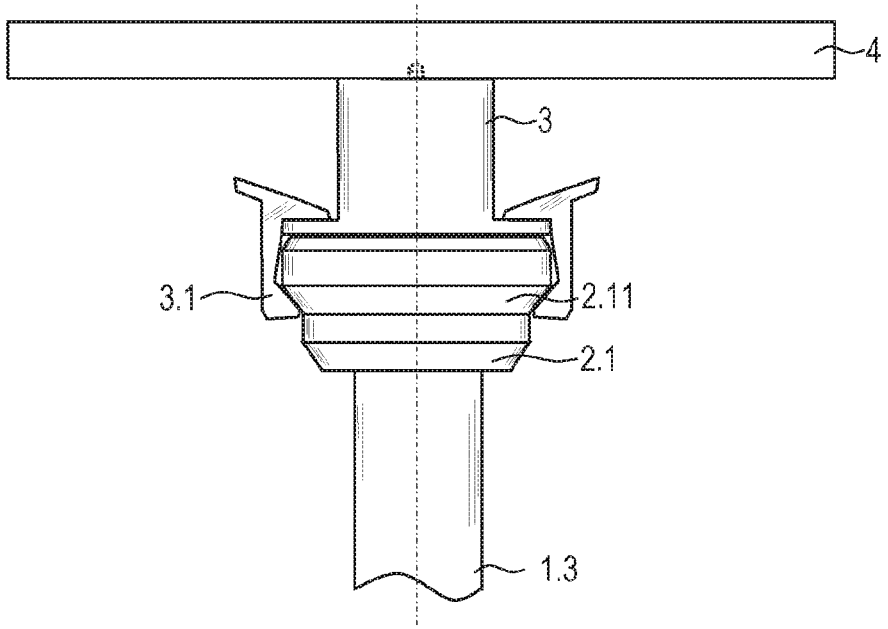

In accordance with FIG. 5 through 7, the cable may be coupled to socket body 3 in the sense of a plug-type connection, socket body 3 being permanently mounted to a circuit board 4 of an on-board electronics, for example. Socket body 3 has snap-fit elements 3.1, as well as two metallic bushings 3.11, 3.21 that are electrically contacted by printed conductors of the circuit board.

When stripped conductors 1.11, 1.21, used as pin contacts, are inserted into bushings 3.11, 3.21 to establish an electrical connection, elastic snap-fit elements 3.1 of socket body 3 wrap around coupling ring 2.1 until they snap into place in cooperation with offset 2.11. In this position, seal 2.3 is axially compressed between socket body 3 and coupling ring 2.1, respectively pin housing 2.2, thereby producing an impervious assembly.

The cable according to an embodiment of the present invention makes it possible for cores 1.1, 1.2 to remain as stranded cores virtually over the complete length of line 1 because the original stranding merely needs to be unraveled over an extremely small section at the end of the cable. The cable is, therefore, relatively insensitive to electromagnetic radiation; respectively, outwardly, it generates relatively little interfering radiation. Therefore, the described cable design eliminates the need for a shielding.

The new cable design also largely prevents, respectively reduces impedance mismatches and any attendant degradation of the signals to be transmitted. The new cable also only has a minimum of hollow spaces. This makes it insensitive to a moisture absorption that could occur, in particular, in response to temperature fluctuations.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A cable, comprising:

a line including a plurality of cores and a sheath, the sheath being radially outwardly disposed relative to the cores, each of the cores having a conductor and an insulation surrounding the conductor, each of the conductors being stripped of the insulation at an end of the cores; and a coupling housing including a coupling ring, a pin housing, and a sealing element, the coupling ring embracing the pin housing and the sheath and being fixed to the sheath, the pin housing surrounding the stripped ends of the conductors, the sealing element being disposed between the coupling ring and the pin housing, an end of the pin housing having one or more slots disposed at an outer circumferential edge of the end of the pin housing such that the end of the pin housing is compressible, wherein the conductors are formed of a solid and coated steel wire and the stripped ends of the conductors are useable as pin contacts.

2. The cable as recited in claim 1, wherein the stripped ends of the conductors useable as the pin contacts are rounded.

3. The cable as recited in claim 1, wherein the stripped ends of the conductors useable as the pin contacts have a chamfer.

4. The cable as recited in claim 1, wherein the stripped ends of the conductors are machine cut to produce a curvature or a chamfer.

5. The cable as recited in claim 1, wherein the stripped ends of the conductors are coated to produce a curvature or a chamfer.

6. The cable as recited in claim 1, wherein, within the line, the conductors have a same spacing as the stripped ends of the conductors useable as the pin contacts.

7. The cable as recited in claim 1, wherein the pin housing is fixed to the sheath by a press-fit connection.

8. The cable as recited in claim 1, wherein the pin housing is fixed to the sheath by an adhesive bond.

9. The cable as recited in claim 1, wherein the sealing element is an O-ring seal.

10. The cable as recited in claim 1, wherein the sealing element is integrally formed on the pin housing.

11. The cable as recited in claim 1, wherein the sealing element is embraced by the coupling ring.

12. The cable as recited in claim 1, wherein the pin housing has at least one snap-fit element at the outer circumferential edge of the pin housing in a region which engages within the coupling ring.

13. The cable as recited in claim 1, wherein, the coupling ring, on an outer surface thereof, has an offset that is suited for locking engagement with a socket body.

14. The cable as recited in claim 1, wherein the line is in an unshielded form.

15. The cable as recited in claim 1, wherein, due to a geometric form of the coupling ring and the pin housing and the one or more slots, the pin housing is compressed at the end and pressed against an outer circumferential surface of the sheath.

16. The cable as recited in claim 1, wherein the end of the pin housing having the slots is disposed within the coupling ring.

17. The cable as recited in claim 1, wherein the coupling ring embraces the sheath over a first axial extent and embraces the pin housing over a second axial extent, and wherein the first and second axial extents overlap with each other.

* * * * *